US006811807B1

(12) United States Patent
Zimmermann et al.

(10) Patent No.: US 6,811,807 B1
(45) Date of Patent: Nov. 2, 2004

(54) METHOD OF APPLYING A PEEL-OFF PROTECTIVE LAYER

(75) Inventors: Konrad Zimmermann, Troisdorf (DE); Klaus Peter Reinke, Ebstorf (DE)

(73) Assignee: Nordson Corporation, Westlake, OH (US)

( * ) Notice: Subject to any disclaimer, the term of this patent is extended or adjusted under 35 U.S.C. 154(b) by 63 days.

(21) Appl. No.: 10/049,165

(22) PCT Filed: Jun. 24, 2000

(86) PCT No.: PCT/EP00/05843

§ 371 (c)(1),
(2), (4) Date: Oct. 1, 2002

(87) PCT Pub. No.: WO01/10570

PCT Pub. Date: Feb. 15, 2001

(30) Foreign Application Priority Data

Aug. 10, 1999 (DE) ..... 199 36 790

(51) Int. Cl.[7] ..... B05D 3/14

(52) U.S. Cl. ..... 427/10; 427/385.5; 427/407.1; 427/421

(58) Field of Search ..... 427/10, 385.5, 427/407.1, 421

(56) References Cited

U.S. PATENT DOCUMENTS

| | | | | |
|---|---|---|---|---|
| 4,562,088 | A | 12/1985 | Navarro | 427/8 |
| 5,868,845 | A | 2/1999 | Rouvelin | 118/663 |

FOREIGN PATENT DOCUMENTS

| | | | |
|---|---|---|---|
| DE | 19652728 | A1 | 6/1997 |
| DE | 19727484 | A1 | 2/1999 |
| DE | 19854760 | A1 | 5/2000 |

*Primary Examiner*—Bernard Pianalto
(74) *Attorney, Agent, or Firm*—Wood, Herron & Evans, L.L.P.

(57) ABSTRACT

A process for producing a peel-off protective layer for surfaces, especially for painted surfaces of motor vehicle bodies. A curable liquid coating material is sprayed by a spray nozzle onto the surface to be protected, where it forms a two-dimensional protective layer which cures. Coating material emerging essentially as a continuous strand or strip of material from an applicator nozzle is applied to the surface to be coated at the edges of the areas of the coating material which has been sprayed onto the surface.

13 Claims, 1 Drawing Sheet

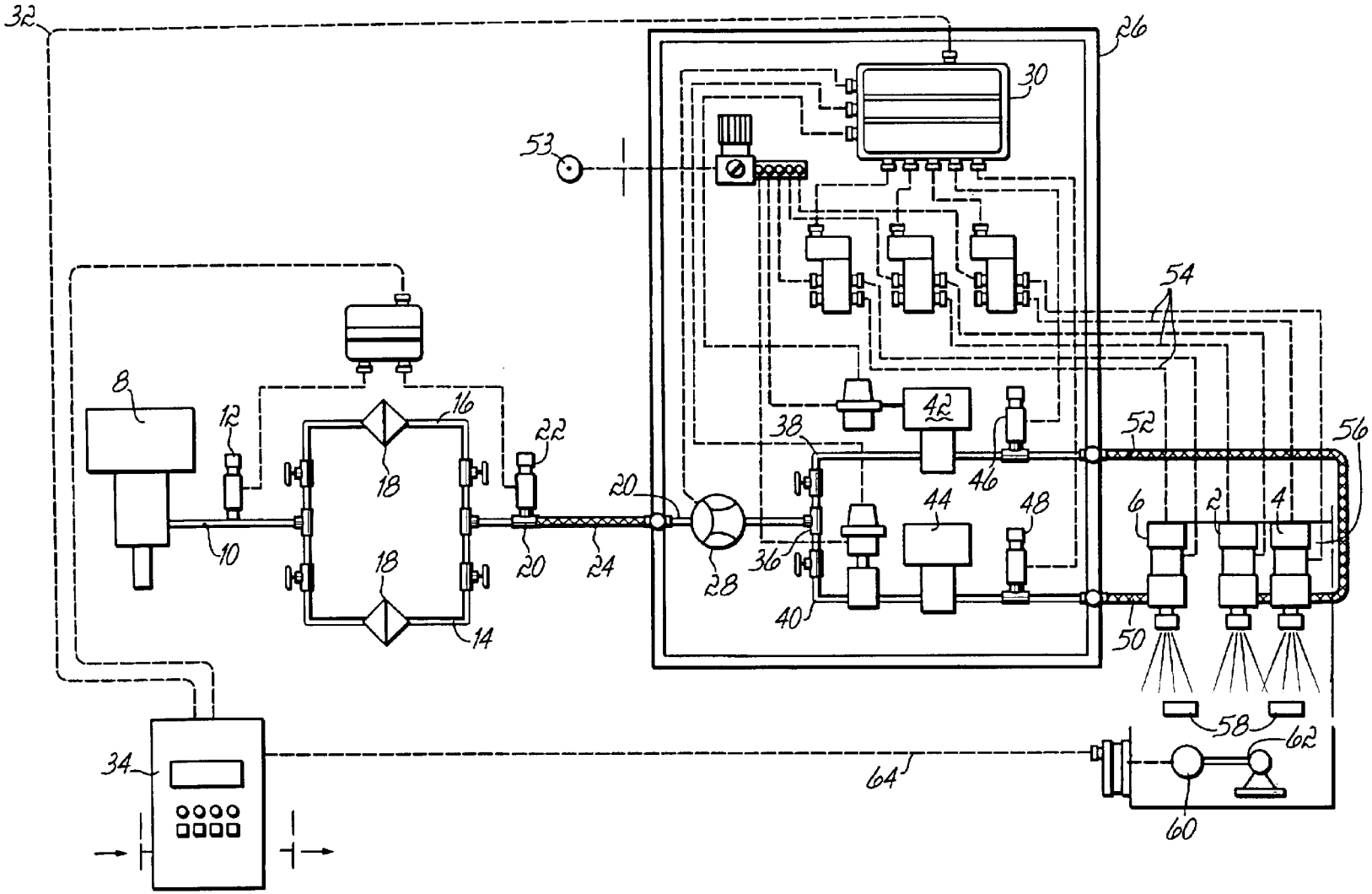
56
4
2
6
54
52
50
62
58
60
26
30
48
46
42
44
64
38
36
40
28
20
24
53
22
20
16
14
18
18
12
10
8
34
32

METHOD OF APPLYING A PEEL-OFF PROTECTIVE LAYER

FIELD OF THE INVENTION

The present invention pertains to a process and a device for producing a peel-off protective layer for surfaces, especially the painted surfaces of motor vehicle bodies, in which a curable liquid coating material is sprayed from a spray nozzle onto the surface to be protected and forms there a two-dimensional protective layer when cured.

Peel-off protective layers are placed on the painted surfaces of motor vehicles to protect them from environmental influences such as dirt and intense sunlight, especially during transport from the motor vehicle manufacturer and until the time of delivery to the customer. The protective layer is produced at the manufacturer's plant by the application of a liquid to the painted surface of a motor vehicle, and then this liquid is cured or solidified. The liquid can be an aqueous dispersion from which the water evaporates during curing, so that a kind of peel-off film is formed on the surface. The film thus produced can then be peeled off by hand before the vehicle is delivered to the buyer.

A significant disadvantage of conventional processes is that, because the liquid coating material is sprayed on, it is impossible to obtain a sharp contour at the edges of the sprayed-on areas of coating material; instead, individual particles or droplets are formed in the edge areas, which are separate and detached from the continuous protective layer ("overspray"). A protective layer in the form of individual particles does not offer sufficient protection to the paint after curing and also makes it almost impossible for the cured protective layer to be gripped by hand so that it can be peeled off. The individual particles, furthermore, must be removed manually or by some other labor-intensive means.

For these and other reasons, it would be desirable to provide a process and a device for producing a sharply contoured protective layer on a surface, such as the painted surfaces of motor vehicle bodies.

BRIEF SUMMARY OF THE INVENTION

The invention is directed to a process in which coating material emerges essentially as a continuous strand or strip of material from an applicator nozzle and is applied to the surface to be coated at the edges of the areas which have been sprayed with the coating material.

The invention is further directed to a device having at least one applicator nozzle for the application of coating material as an essentially continuous strand or strip of material to the surface to be coated.

The process according to the invention and the device according to the invention make it possible to produce a protective layer for surfaces having sharply defined lateral edges and thus a defined size. Because a continuous or nearly continuous strand or strip of material is applied to the edge areas of the sprayed-on coating material, a clean, sharply contoured edge is formed, without the occurrence of individual particles or droplets (overspray), which then cure on the surface. The sharply contoured, overspray-free edge can, after it has cured, be gripped easily by hand and lifted, and the protective layer thus produced can then be easily peeled off. According to the invention, a relatively large area is coated by spraying on the coating material, whereas, during or after the spraying step, an applicator nozzle which produces an essentially continuous strand or strip of material is used to produce a sharp-edged, overspray-free coating in the area of the outer edges of the sprayed-on coating, where individual sprayed-on liquid particles can be scattered.

According to an especially preferred embodiment of the process according to the invention, it Is provided that the protective layer sprayed on by the spray nozzle and the protective layer applied by the applicator nozzle consist of the same coating material and coalesce to form a single protective layer on the surface before they have cured. The viscosity of the coating material, which is essentially a function of temperature, is selected so that the coating material sprayed on by the spray nozzle and the coating material applied by the applicator nozzle flow into each other and form a single layer. The sprayed particles in the edge area coalesce completely with the coating material which has been applied as an essentially continuous strand or strip of material.

According to an elaboration of the process according to the invention, it is proposed that the protective layer sprayed on by the spray nozzle and the protective layer applied by the applicator nozzle have a thickness such that a protective layer is formed which, in the completely cured state, forms a completely closed protective layer which is essentially impermeable to water, gas, and dust and which can be peeled off by hand. A protective layer of this type is liquid-repellent, but does not usually dissolve upon contact with water and provides reliable protection during transport.

An especially preferred alternative embodiment of the process according to the invention is characterized in that the coating material emerges from the applicator nozzle as a flat strip of material which expands as its distance from the applicator nozzle increases. A flat strip of material of this type can be laid onto the surface in a defined manner at the edges of the previously or simultaneously sprayed-on coating. In the cured state, the protective layer can then be gripped by hand at this edge and peeled off without causing the protective layer to tear. For example, a slit nozzle or a specially designed nozzle with an essentially rectangular discharge opening could be used.

According to an alternative embodiment, it is provided that several strands or strips of material are applied from several applicator nozzles to the edge areas of the coating material sprayed onto the surface. In this way, a relatively wide overspray area can be covered with coating material.

To obtain a protective layer with a large surface area, it is provided that the coating material is sprayed on in an overlapping manner by means of several adjacent spray nozzles. The degree of overlap can be varied; it depends on the pressure of the coating material in the feed line and on the distance between the individual spray nozzles.

Another elaboration of the invention is characterized in that the spray nozzle and the applicator nozzle are fed from a common coating material source but by two coating material streams which are at least partially separate from each other. Because of the use of two separate coating material streams, it is possible for the pressure in one of the feed lines to be different from that in the other. The pressure of the coating material in the feed line to the spray nozzle will usually be much higher than the pressure in the coating material feed line to the applicator nozzle. In addition, the coating material can be supplied to the spray nozzle and to the applicator nozzle in alternation; in most cases, according to a preferred embodiment described in greater detail further below, the material will first be sprayed on over a wide area, and then a sharply contoured edge will be produced at the edge areas by means of the applicator nozzle.

According to a further elaboration of the process, it is provided that the pressures in the separate coating material streams leading to the applicator nozzle and to the spray nozzle are adjustable or controllable. The flow rates, measured either by weight or volume, of the separate coating material streams being supplied to the applicator nozzle and to the spray nozzle can preferably be adjusted or controlled also, so that precisely predetermined amounts of coating material can be applied to a specific surface and thus also so that the thickness of the protective layer can be predetermined.

By adjusting the temperature of the coating material automatically to a desired nominal value, it is possible effectively to control the flow properties or viscosity of the coating material, to control its spray or application behavior, and ultimately to control certain properties of the protective layer. The process according to the invention is especially safe for the environment when the coating material is water-based and the water evaporates during the curing process.

According to another especially preferred embodiment of the process, it is provided that the coating material emerging from the spray nozzle or applicator nozzle is subjected to spray jet monitoring, in which the emerging coating material is introduced into the path of a beam of light, so that the interruption of the beam can be detected by an optical sensor and analyzed by a control unit. Before the protective layer itself is actually produced on the surface, the spray jet emerging from the spray nozzle and/or the strand or strip of material emerging from the applicator nozzle is analyzed to determine whether, for example, the width of the spray cone or of the strand or strip of material, which expands with increasing distance from the discharge opening of the applicator nozzle, has the desired form. If spray jet monitoring shows that the spray pattern is not optimal, a parameter such as the temperature of the coating material or the pressure of the coating material in a feed line to the spray nozzle or to the applicator nozzle can be varied, or the nozzle can be cleaned until the desired spray pattern is obtained. Through these measures, it can be guaranteed that a uniform protective layer of sufficient thickness will be produced.

The process is especially advantageous when the coating material is sprayed on first and the strand or strip of material is then applied to the edges of the sprayed-on areas of coating material. In this way, it is possible with a single robot arm to spray a large area and then to produce a sharp edge contour by guiding the applicator nozzle along the edges. To produce a large coated area, it is advisable to use one or more spray nozzles to spray on several swathes of coating material essentially parallel to each other. According to an elaboration, it is provided that the spray nozzle and the applicator nozzle are moved by a robot arm along preprogrammable paths relative to the surface to be coated.

The previously described advantages of the process according to the invention are achieved in like manner by means of a device according to the invention, so that, to avoid repetition, reference is made herewith to the above description of the advantages of the process according to the invention.

The device according to the invention is advantageously elaborated in that the spray nozzle and the applicator nozzle are attached to a common frame so that they can be moved by means of a robot arm relative to the surface to be protected. A further elaboration provides that several applicator nozzles and spray nozzles are attached next to each other on the frame in such a way that they can be mounted at various distances from each other.

To arrive at different sets of flow conditions, especially to set different pressures, it is provided in accordance with an elaboration of the process according to the invention that the spray nozzle and the applicator nozzle are fed independently of each other with coating material through two separate coating material lines. It can be advisable, for example, to use a much higher pressure for the spray nozzle than for the applicator nozzle, from which a continuous strand of material emerges. To set the desired pressure, an automatic pressure controller is provided in each of the coating material lines, by means of which the pressure of the coating material in the coating material lines can be adjusted to the desired value.

An optical system for monitoring the spray jet is preferably realized by a light source for producing a beam of light, by an optical sensor for detecting incident light and for generating an electrical signal as a function of the intensity of the incident light, and by a control unit connected to the optical sensor for evaluating the optical signals generated by the sensor, so that the coating material streams discharged by the applicator nozzle and the spray nozzle can be monitored. The material properties of the coating material can be influenced favorably by a heating device for tempering the material.

These and other features, objects and advantages of the invention will become more readily apparent to those of ordinary skill in the art upon review of the following detailed description, taken in conjunction with the accompanying drawings.

BRIEF DESCRIPTION OF THE DRAWINGS

The FIGURE is a schematic diagram of a device for the production of a peel-off protective layer on the painted surfaces of motor vehicles or their bodies.

DETAILED DESCRIPTION OF THE INVENTION

The exemplary embodiment of a device according to the invention comprises essentially two spray nozzles 2, 4; an applicator nozzle 6; a system of supply lines, to be explained in greater detail below, for feeding coating material to the spray and applicator nozzles 2, 4, 6; and a pump 8, connected to a coating material source (not shown), for conveying the coating material.

The pump 8 is connected on the delivery side to a line 10, to which a pressure transducer 12 for detecting the pressure of the coating material in the line 10 is connected. The line 10 divides in the flow direction of the coating material into two branches, in each of which a filter 18 and a valve are installed, so that the coating material, depending on the positions of the valves, is conveyed either through the filter 18 in branch 16 or through the filter 18 in branch 14. In the line 20, following after the branch lines 14, 16, there is another pressure transducer 22. A conclusion concerning the state of the filters 18 can be drawn from the difference between the pressure value detected by transducer 22 and that detected by transducer 12. Line 20 contains a flexible, possibly heatable, hose 24.

Within a control panel 26, located further along the course of the line 20, there is a volume flow rate measuring cell 28. The signals generated by the volume flow rate measuring cell 28 are transmitted over a signal line (shown in broken lines) to a central switch box 30 in the panel 26. The switch box 30 is connected by several lines 32, also shown schematically in broken lines, to a control unit 34, which is equipped with a display field and several buttons and switches for entering commands and which is possibly connected to the central control unit of a production plant.

At a T-distributor 36, the line 20 divides into two separate coating material lines 38, 40. An automatic membrane pressure controller 42, 44 and a pressure transducer 46, 48 are installed in each of these two coating material lines 38, 40, so that it is possible to adjust the pressure in the further course of the coating material lines 38, 40 to different values and to measure those pressures. The automatic pressure controllers 42, 44 and pressure transducers 46, 48 are connected to the switch box 30 by signal lines, also shown in broken lines. The coating material line 40 is connected by a flexible and thermally insulated hose 50 to the applicator nozzle 6. The coating material line 38 is connected by a hose 52 to the two spray nozzles 2, 4, which can be supplied with coating material either simultaneously or, if desired, separately, via an appropriate set of connections.

An individually actuatable pneumatic applicator valve (not shown) is assigned to each of the spray nozzles 2, 4 and to the applicator nozzle 6, the valve needles of which can be moved by pistons, which can be moved pneumatically back and forth by compressed air relative to their valve seats to block or release the feed of coating material to the discharge openings. The applicator valves can be driven via compressed air lines 54 containing electromagnetically actuated solenoid valves, which are themselves driven from the switch box 30 via the lines 32 with the control unit 34. The solenoid valves are connected to a compressed air source 53.

The spray nozzles 2, 4, and the applicator nozzle 6 are attached to a common frame 56. They can be mounted on the frame 56 at various distances away from each other. For this purpose, the spray and applicator nozzles 2, 4, 6 can be slid along a rail and locked in place there by clamping screws. The frame 56 is attached in turn to a robot arm (not shown) which moves along programmable routes, so that the spray nozzles 2, 4 and the applicator nozzle 6 can be shifted along predetermined paths relative to a surface to be coated, which, in this exemplary embodiment, is a motor vehicle. In a manner not illustrated here, additional spray nozzles and applicator nozzles can also be attached to the frame 56, if called for by a specific application.

Two schematically illustrated spray jet monitoring devices 58 are used to analyze the spray jets emerging from the spray guns 2, 4 and the strand or strip of material emerging from the applicator nozzle 6. By means of the previously described robot arm, the spray nozzles 2, 4 and the applicator nozzle 6 can thus be moved up to the spray jet monitoring devices 58 so that analysis is possible. Each spray jet monitoring device 58 has a light source, preferably a laser, which produces a beam of light, and an optical sensor a certain distance away from the light source to detect the incident light and to generate an electrical signal as a function of the intensity of this incident light. The spray pattern obtained in an individual case can, for example, be analyzed with respect to a desired, predetermined width a certain distance away from the discharge opening of the associated spray nozzle 2, 4, or applicator nozzle 6. It is also possible to study the degree of uniformity of the spray pattern. The electrical signals generated by the one or more optical sensors, which signals are a measure of the intensity of the incident light, are transmitted to an electrical or electronic control unit for evaluation of the signals and processed there to obtain information concerning the spray pattern in question.

A compressed air-operated air motor 60 drives a rotating brush 62, by means of which the discharge openings of the spray nozzles 2, 4 and of the applicator nozzle 6 can be cleaned, the robot arm being used to bring the nozzles up to the brush 62. The air motor 60 can be driven via a signal line 64.

The operation of the device and the process according to the invention are described below.

The liquid coating material, which can be an aqueous dispersion or the like, is conveyed by means of the pump 8 through the line 10. It flows through one of the filters 18 in the line 20 and through the volume flow rate measuring cell 28. In a preferred exemplary embodiment, coating material is conveyed first through the coating material line 38 and the hose 52 to the spray nozzles 2, 4 under a pressure of up to approximately 30 bars. The material is applied by the spray nozzles 2, 4 as a flat coating to a vehicle body, in that the spray nozzles 2, 4 are moved together with the frame 56 by a robot arm along a predetermined path, so that a uniformly applied coating of the material is sprayed onto the surface. For example, the spray nozzles 2, 4 can be moved back and forth along essentially straight paths.

After completion of the sprayprocess, the applicator valves of the spray nozzles 2, 4 are closed. The applicator nozzle 6 is brought to the edge area of the previously applied spray coating, and the applicator valve of the applicator nozzle 6 is opened, so that the coating material is applied to the surface through the coating material line 40, the hose 50, and the applicator nozzle 6 in the form of an essentially continuous strand or strip of material emerging as a jet from the applicator nozzle 6. The applicator nozzle 6 is guided along the edge area of the sprayed-on area of coating material so that a completely closed protective layer is formed, which consists of the sprayed-on coating material and the coating material applied subsequently in the form of a continuous strand or strip of material. Because of the ability of the coating material to flow before it cures, the coating material sprayed on by the spray nozzles 2, 4 and the coating material applied by the applicator nozzle 6 coalesce with each other to form a single protective layer. This then cures completely. It can be peeled off by hand from the surface at a later time.

The protective layer which has been sprayed on and applied by the applicator nozzle 6 has a thickness such that, in the cured state, it forms a completely closed protective layer, which can be peeled off. The coating material strand or strip emerging from the applicator nozzle 6 can, for example, be produced by a slit nozzle; other types of nozzles could also be used. According to a variant of the process, coating material emerges from the applicator nozzle as a flat strip of material, which expands with increasing distance from the applicator nozzle.

The pressure in the coating material lines 38, 40 can be adjusted by means of the automatic pressure controllers 42, 44. The same is true for the temperature of the coating material, which can be set or brought to a desired nominal value by means of a tempering device (not shown).

Before the protective layer itself is actually produced, the spray pattern of the spray nozzles 2, 4 and of the applicator nozzle 6 can be studied by means of the spray jet monitoring devices 58, as previously described.

While the present invention has been illustrated by a description of various preferred embodiments and while these embodiments has been described in some detail, it is not the intention of the Applicants to restrict or in any way limit the scope of the appended claims to such detail. Additional advantages and modifications will readily appear to those skilled in the art. The various features of the invention may be used alone or in numerous combinations depending on the needs and preferences of the user. This has been a description of the present invention, along with the preferred methods of practicing the present invention as currently known.

However, the invention itself should only be defined by the appended claims, wherein what is claimed is:

1. A method of applying a peel-off protective layer to a surface, comprising:

spraying a first curable liquid coating material onto an area of the surface;

applying a second curable liquid coating material onto the surface adjacent to a lateral edge of the area; and curing the first and the second curable liquid coating materials to provide the peel-off protective layer.

2. The method of claim 1 wherein the second curable liquid material is applied with an applicator nozzle, and the applying of the second curable liquid coating material further includes discharging a flat strip of the second curable liquid coating material such that the width of the strip increases with increasing distance from the applicator nozzle.

3. The method of claim 1 further comprising applying a second curable liquid coating material onto the surface adjacent to a different lateral edge of the area.

4. The method of claim 1 wherein the spraying of the first curable liquid coating material includes directing individual sprays from each of a plurality of adjacent spray nozzles to the area of the surface in an overlapping fashion.

5. The method of claim 1 wherein the first and the second curable liquid coating materials have identical compositions, and further comprising providing the first and the second curable liquid coating materials for spraying and applying, respectively, in individual coating material streams from a common coating material source.

6. The method of claim 5 further comprising adjusting at least one of the pressure and the flow rate of each of the individual coating material streams.

7. The method of claim 5 further comprising automatically controlling at least one of the pressure and the flow rate of each of the individual coating material streams.

8. The method of claim 1 further comprising heating the first and the second curable liquid coating materials to a desired temperature.

9. The method of claim 1 wherein the first and the second curable liquid coating materials are water-based, and the curing of the first and the second curable liquid coating materials includes evaporating water from the first and the second curable liquid coating materials to provide the peel-off protective layer.

10. The method of claim 1 further comprising monitoring the spraying of the first and the applying of the second curable liquid coating materials with an optical sensor.

11. The method of claim 1 wherein the spraying of the first curable liquid coating material onto the area occurs before the application of the second curable liquid coating material to the lateral edge of the area.

12. The method of claim 1 wherein the spraying of the first curable liquid coating material includes directing multiple parallel swathes of the first liquid curable coating material onto the area of the surface.

13. The method of claim 1 wherein the first curable liquid coating material is sprayed from a spray nozzle and the second curable liquid coating material is applied from an applicator nozzle, and further comprising moving the spray nozzle and the applicator nozzle along respective preprogrammable paths relative to the surface during the steps of spraying and applying.

* * * * *